United States Patent [19]

Ishizawa et al.

[11] Patent Number: 4,697,994

[45] Date of Patent: Oct. 6, 1987

[54] MULTISTAGE DISCHARGE TYPE ROTARY VACUUM PUMP

[75] Inventors: Tadao Ishizawa; Hirofumi Kotaka; Masami Kakinuma, all of Narashino, Japan

[73] Assignee: Seiko Seiki Kabushiki Kaisha, Chiba, Japan

[21] Appl. No.: 684,126

[22] Filed: Dec. 20, 1984

[30] Foreign Application Priority Data

Dec. 28, 1983 [JP] Japan ..... 58-251034

[51] Int. Cl.[4] ..... F04C 18/344; F04C 25/02

[52] U.S. Cl. ..... 418/8; 418/13

[58] Field of Search ..... 418/8, 11–13, 418/5

[56] References Cited

U.S. PATENT DOCUMENTS

| | | | |
|---|---|---|---|
| 1,895,816 | 1/1933 | Pfeiffer | 418/13 |
| 1,983,997 | 12/1934 | Rolaff | 418/8 |
| 3,381,891 | 5/1968 | Bellmer | 418/13 |
| 3,707,339 | 12/1972 | Budgen | 418/13 |
| 4,239,466 | 12/1980 | Abbey | 418/11 |

FOREIGN PATENT DOCUMENTS

| | | | |
|---|---|---|---|
| 617377 | 11/1926 | France | 418/13 |
| 56-81291 | 7/1981 | Japan | 418/8 |
| 57-38691 | 3/1982 | Japan | 418/8 |
| 153327 | 2/1922 | United Kingdom | 418/13 |

*Primary Examiner*—John J. Vrablik

*Attorney, Agent, or Firm*—Bruce L. Adams; Van C. Wilks

[57] ABSTRACT

A multistage discharge type rotary vacuum pump comprises a rotor rotably mounted within a cylinder chamber and dividing the cylinder chamber into first stage and second stage working chambers. A plurality of radially extending vanes are slidably mounted in the rotor in angularly spaced relation, and the vanes undergo radial sliding movement during rotation of the rotor such that the vane tips maintain sliding contact with the cylinder chamber. Each working chamber has an inlet port at the upstream side thereof for admitting exhaust gas evacuated from a confined space during use of the pump, and an outlet port at the downstream side thereof for discharging the exhaust gas which has been compressed in the working chamber in response to rotation of the rotor. The outlet port of the first stage working chamber communicates through a discharge valve with a storage chamber, and the storage chamber communicates through a pressure-responsive discharge valve with the inlet port of the second stage working chamber. The exhaust gas which is discharged from the first stage working chamber is stored in the storage chamber and whenever the gas pressure reaches a predetermined value, the pressure-responsive discharge valve opens to admit the compressed exhaust gas through the inlet port into the second stage working chamber. Such a construction enables miniaturization of the pump structure, a reduction in the driving force for rotationally driving the rotor, and an increased exhaust efficiency of the pump.

5 Claims, 1 Drawing Figure

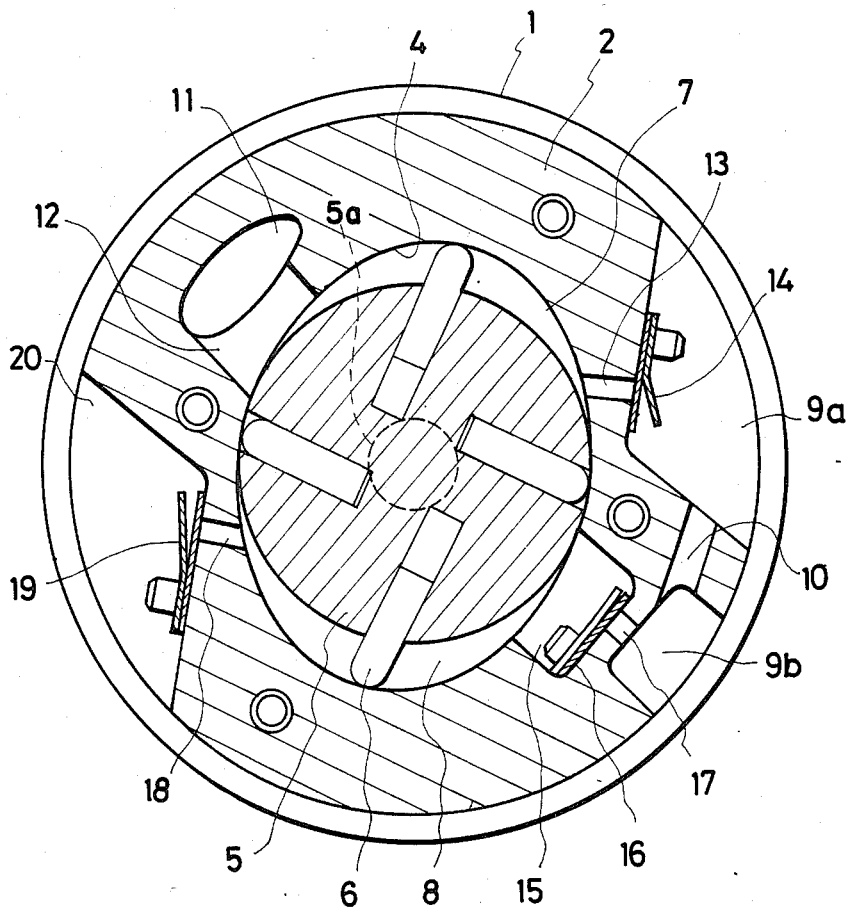
1
2
4
7
11
13
12
5a
14
20
9a
19
10
9b
18
17
5
6
8
15
16

MULTISTAGE DISCHARGE TYPE ROTARY VACUUM PUMP

BACKGROUND OF THE INVENTION

1. Field of the Invention

This invention relates to a multistage discharge type rotary vacuum pump having a multiplicity of discharge stages with a single rotor and stator set.

3. Description of the Prior Art

In most conventional rotary vacuum pumps, only one working chamber is formed in a cylinder chamber as in the Gaede type pump.

Heretofore, in order to obtain high vacuum with this type of rotary vacuum pump, multistage discharge was conducted by connecting a plurality of rotor and stator sets in a tandem through a common rotor shaft and connecting a discharge port of an upstream stage to an inlet port of a downstream stage of each pump.

However, this kind of structure requires a large size and a complicated apparatus and requires an increased driving force.

OBJECT OF THE INVENTION

Accordingly, it is an object of this invention to provide a multistage discharge type rotary vacuum pump which enables miniaturization of the apparatus and reduction of the required driving force by carrying out multistage discharge with a single rotor and stator set.

SUMMARY OF THE INVENTION

To this end this invention provides a multistage discharge type rotary vacuum pump comprising: a rotor rotatably and horizontally carried in a cylinder chamber and separating the cylinder chamber into a plurality of working chambers; a plurality of vanes arranged slidably in the radial direction of the rotor; a passageway connecting a discharge port of a working chamber at a first stage with an inlet port of a working chamber at a second stage; an intermediate stage chamber formed in the connecting passageway for storing exhaust gas exhausted from the working chamber at the first stage; and an intermediate discharge valve for discharging the exhaust gas into the inlet port of the working chamber at the second stage when the exhaust gas pressure of the exhaust gas stored in the intermediate storage chamber reaches a predetermined pressure.

BRIEF DESCRIPTION OF THE DRAWING

The single drawing is a side sectional view of a two-stage discharge type rotary pump which embodies a multistage discharge type rotary vacuum pump according to the invention.

DETAILED DESCRIPTION OF THE PREFERRED EMBODIMENTS

The attached single illustration shows a two-stage discharge type rotary vacuum pump which embodies a multistage discharge type rotary vacuum pump according to the invention.

In the FIGURE, a stator or cylinder 2 having an inner peripheral surface with the shape, for example, of a substantial ellipse, is encased in a casing 1. In the front and rear part of the stator 2, a front side block and a rear side block (not shown) are mounted, which together form an ellipsoidal cylindrical cylinder chamber 4.

A rotor 5 carries a plurality of vanes 6 which are arranged slidably in the radial direction, and the rotor 5 is connected to a shaft **5*a* which is rotatably supported by the front side block and the rear side block so as to rotatably and horizontally mount the rotor 5 in the cylinder chamber 4**.

The rotor 5 is dimensioned such that diametrically opposite parts thereof make sliding contact with the smaller diameter sides of the cylinder chamber 4. The rotor 5 divides the cylinder chamber 4 into two equal parts which define crescent-shaped working chambers 7, 8 of equal volume at the larger diameter sides of the of the cylinder chamber 4.

In the stator 2 are formed a first inlet port 12 and a first discharge port 13 communicating with the working chamber 7, and a second inlet port 15 and a second discharge port 18 communicating with the working chamber 8. On the outside of each discharge port 13, 18, is mounted a discharge valve 14, 19, respectively.

Two intermediate storage chambers or compartments **9*a*, 9*b*, are provided between the outer wall of the stator 2 and the inner wall of the casing 1, and these intermediate chambers are connected to and communicate with each other through a throughbore 10. On the inner wall of the intermediate storage chamber 9*a* is mounted the discharge valve 14, and in the other intermediate storage chamber 9*b* is provided a discharge port 17 for communicating the working chamber 8 with the intermediate chamber 9*b* via the inlet port 15. An intermediate pressure-responsive discharge valve 16 is mounted on the inner wall of the inlet port 15. The intermediate discharge valve 16 is made to open or release when the exhaust gas pressure within both intermediate storage chambers 9*a*, 9*b*** reaches a predetermined value.

Further, the first inlet port 12 is connected to communicate with a source of low pressure gas contained in a confined space which is to be evacuated (not shown) through the inlet port 11 which opens to the front side block, and the discharge port 18 is connected to communicate to the outside through a space 20 formed between the stator 2 and the casing 1 and a discharge port formed on the rear side block.

In this structure, when the rotor 5 rotates clockwise, the vanes 6 project radially outwardly and their end tips slidably contact with the wall surface of the cylinder chamber 4 to effect the intake and exhaust of gas in each working chamber 7, 8.

In the first stage working chamber 7, in response to the rotating movement of the rotor 5 and vanes 6, low pressure gas is taken in through the inlet port 12 at the upstream side of the working chamber 7, and the gas is compressed and discharged through the discharge valve 14 to exhaust the exhaust gas into the intermediate storage chamber **9*a* through the discharge port 13 at the downstream side of the working chamber 7. When the intermediate storage chambers 9*a*, 9*b* cumulatively fill with exhaust gas and the exhaust gas pressure reaches a predetermined value after repetitions of this cycle of operation, the intermediate discharge valve 16 opens and the exhaust gas is discharged from the discharge port 17 into the second inlet port 15**.

In the second stage working chamber 8, the exhaust gas is admitted from the second inlet port 15, and the exhaust gas is further compressed and discharged through the discharge valve 19 into the space 20. As a result, the compressed exhaust gas is discharged into the atmosphere through the discharge port 18.

In this way, two-stage discharge is conducted by the two working chambers 7, 8. The provision of the intermediate storage chambers 9a, 9b between the two working chambers effectively heightens the exhaust efficiency.

EFFECTS OF THE INVENTION

According to this invention, a rotor and stator set enables a multistage discharge, miniaturization of the apparatus and a reduction in the required driving force. Furthermore, the provision of the intermediate chambers heightens the exhaust efficiency of the vacuum pump.

We claim:

1. A multistage rotary vacuum pump for evacuating gas from a confined space, comprising: a casing; a cylinder housed within the casing and having means therein defining a cylinder chamber; a rotor mounted to undergo rotation in a given direction within the cylinder chamber and coacting therewith to divide the cylinder chamber into at least first stage and second stage working chambers; a plurality of radially extending vanes slidably mounted in the rotor in angularly spaced relation therearound to undergo radial movement such that the vane tips maintain sliding contact with the wall of the cylinder chamber during rotation of the rotor; means defining an inlet port opening into the upstream side of the first stage working chamber for admitting thereinto gas evacuated from a confined space in response to rotation of the rotor; means defining an inlet port opening into the upstream side of the second stage working chamber; means defining an outlet port at the downstream side of each working chamber for discharging therefrom gas which has been compressed in the working chamber in response to rotation of the rotor; and pressure-responsive storage means housed entirely within the casing and communicating with the outlet port of the first stage working chamber for receiving therefrom and cumulatively storing therein the compressed gas and communicating with the inlet port of the second stage working chamber for admitting thereinto the stored compressed gas whenever the pressure thereof reaches a predetermined value, the pressure-responsive storage means comprising means defining a pair of compartments separated from one another by a wall, one of the compartments commmunicating with the outlet port of the first stage working chamber and the other of the compartments communicating with the inlet port of the second stage working chamber, a throughbore extending through the wall to provide fluid communication between the pair of compartments, and pressure-responsive valve means for admitting compressed gas stored in said other compartment to the inlet port of the second stage working chamber when the pressure thereof reaches a predetermined value.

2. A multistage rotary vacuum pump according to claim 1; wherein the pair of compartments are located between an inner wall of the casing and an outer wall of the cylinder.

3. A multistage rotary vacuum pump according to claim 2; wherein the wall separating the pair of compartments comprises a wall portion of the cylinder.

4. A multistage rotary vacuum pump according to claim 3; including a one-way discharge valve disposed at the outlet port of the first stage working chamber.

5. A multistage rotary vacuum pump according to claim 4; wherein the pressure-responsive valve means comprises a pressure-responsive one-way discharge valve disposed at the inlet port of the second stage working chamber.

* * * * *